US006718554B1

(12) United States Patent
Langston

(10) Patent No.: US 6,718,554 B1
(45) Date of Patent: Apr. 13, 2004

(54) HANDS FREE TOWEL CARRYING SYSTEM

(76) Inventor: Gloria L. Langston, 2 S. 481 River Oaks Dr., Warrenville, IL (US) 60555

( * ) Notice: Subject to any disclaimer, the term of this patent is extended or adjusted under 35 U.S.C. 154(b) by 0 days.

(21) Appl. No.: 10/358,631

(22) Filed: Feb. 5, 2003

(51) Int. Cl.[7] ..... A41B 13/10
(52) U.S. Cl. ..... 2/49.1
(58) Field of Search ..... 2/48, 49.1, 49.2, 2/49.3, 49.4, 49.5, 50, 51, 52, 88, 89, 92, 69, 206, 207, 175.6, 247, 250, 252, 211, 218; 15/208, 209.1

(56) References Cited

U.S. PATENT DOCUMENTS 470,633 A * 3/1892 Van Gompel et al. ..... 400/147
1,204,655 A * 11/1916 Deutschman ..... 2/88
1,729,817 A * 10/1929 Bullard ..... 2/88
2,250,887 A * 7/1941 Brown ..... 2/49.2
2,620,475 A * 12/1952 Legg et al. ..... 2/50
2,783,472 A * 3/1957 Lenger ..... 2/49.1
2,835,895 A * 5/1958 Wells ..... 2/49.1
2,988,745 A * 6/1961 Whitley et al. ..... 2/48
3,261,025 A * 7/1966 Simek ..... 2/149
3,774,241 A * 11/1973 Zerkle ..... 2/67
4,459,703 A * 7/1984 Kosmas et al. ..... 2/48
4,602,390 A * 7/1986 Morera et al. ..... 2/251
4,646,365 A * 3/1987 Suprise et al. ..... 2/49.2
4,669,128 A * 6/1987 Furgang ..... 2/69
4,698,854 A * 10/1987 Slimmon ..... 2/338
4,975,982 A * 12/1990 Hughes ..... 2/49.1
5,012,543 A * 5/1991 Lewis, Sr. ..... 15/209.1
5,046,195 A * 9/1991 Koritan ..... 2/172
5,046,980 A * 9/1991 Tai et al. ..... 446/73
5,052,055 A * 10/1991 Mysliwiec ..... 2/48
5,062,157 A * 11/1991 Muta ..... 2/171
5,153,943 A * 10/1992 Clement ..... 2/418
5,161,260 A * 11/1992 Reynolds ..... 2/207
5,201,073 A * 4/1993 Spanier ..... 2/49.2
5,211,668 A * 5/1993 Secord ..... 2/203
5,323,491 A * 6/1994 Barrett, Jr. ..... 2/207
5,448,778 A * 9/1995 Phillips ..... 2/172
5,479,662 A * 1/1996 Runco ..... 2/104
5,491,843 A * 2/1996 Naughton ..... 2/48
5,544,364 A * 8/1996 Weber ..... 2/104
5,617,584 A * 4/1997 Brennan ..... 2/206
5,621,916 A * 4/1997 Bell ..... 2/48
5,651,140 A * 7/1997 Gibson ..... 2/46
5,652,958 A * 8/1997 Farrell-Mestas ..... 2/48
5,708,982 A * 1/1998 Armani ..... 2/171
5,756,177 A * 5/1998 Cheong ..... 428/52
5,797,142 A * 8/1998 Debronsky et al. ..... 2/69
5,829,056 A * 11/1998 Hubert ..... 2/48
5,842,228 A * 12/1998 Krainin ..... 2/46
5,860,165 A * 1/1999 Cvijanovich ..... 2/195.1
5,871,132 A * 2/1999 Hargreaves ..... 224/576
5,956,762 A * 9/1999 Adams ..... 2/48
6,175,964 B1 * 1/2001 Adler ..... 2/207
6,219,846 B1 * 4/2001 Toole ..... 2/49.2
6,247,180 B1 * 6/2001 Heinz ..... 2/171
D456,108 S * 4/2002 Frederick ..... D2/629
6,385,774 B1 * 5/2002 Rodgers ..... 2/50
6,505,367 B2 * 1/2003 Griffin et al. ..... 5/655
6,562,437 B2 * 5/2003 Bunkley ..... 428/126

* cited by examiner

*Primary Examiner*—John J. Calvert
*Assistant Examiner*—Alissa L. Hoey
(74) *Attorney, Agent, or Firm*—Edward P. Dutkiewicz

(57) ABSTRACT

A towel of a generally rectangular configuration comprised of an absorbent material has a loose end, a parallel coupling end, a pair of side edges and a generally cylindrical neck loop comprised of an elastomeric material.

2 Claims, 5 Drawing Sheets

HANDS FREE TOWEL CARRYING SYSTEM

BACKGROUND OF THE INVENTION

1. Field of the Invention

The present invention relates to a hands free towel carrying system and more particularly pertains to coupling a towel to a user to prevent loss, theft and contamination.

2. Description of the Prior Art

The use of towel of known designs and configurations is known in the prior art. More specifically, towel of known designs and configurations previously devised and utilized for the purpose of coupling towels to users through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,344,020 issued Mar. 14, 1944, to Walsh discloses a combination beach robe, towel and receptacle. U.S. Pat. No. 4,646,365 issued Mar. 3, 1987, to Suprise et al. discloses a disposable bib with an integral, elasticized neckband. U.S. Pat. No. 4,924,527 issued May 15, 1990, to Hintermeyer discloses a garment protector. U.S. Pat. No. 5,012,543 issued May 7, 1991, to Lewis, Sr. discloses an athletic towel. U.S. Pat. No. 5,052,055 issued Oct. 1, 1991, to Mysliwiec discloses an apron. U.S. Pat. No. 5,652,958 issued Aug. 5, 1997, to Farrell-Mestas discloses a nursing canopy for use by a nursing mother. U.S. Pat. No. 5,724,698 issued Mar. 10, 1998, to Mondragon discloses a folded pocket towel. U.S. Pat. No. 5,787,542 issued Aug. 4, 1998, to Chen discloses a bathing scrubber with massage balls. U.S. Pat. No. 5,855,021 issued Jan. 5, 1999, to Somerville discloses a towel garment. U.S. Pat. No. 6,058,520 issued May 9, 2000, to Wheeler discloses a security sport tote towel. U.S. Pat. No. Des. 292,542 issued Nov. 3, 1987, to Slimmon discloses the ornamental design for a sports towel belt. Lastly, U.S. Pat. No. Des. 400,750 issued Nov. 10, 1998, to Lara, discloses the ornamental design for a washcloth.

While these devices fulfill their respective, particular objectives and requirements, the aforementioned patents do not describe a hands free towel carrying system that allows coupling a towel to a user to prevent loss, theft and contamination.

In this respect, the hands free towel carrying system according to the present invention substantially departs from the conventional concepts and designs of the prior art, and in doing so provides an apparatus primarily developed for the purpose of coupling a towel to a user to prevent loss, theft and contamination.

Therefore, it can be appreciated that there exists a continuing need for a new and improved hands free towel carrying system which can be used for coupling a towel to a user to prevent loss, theft and contamination. In this regard, the present invention substantially fulfills this need.

SUMMARY OF THE INVENTION

In view of the foregoing disadvantages inherent in the known types of towel of known designs and configurations now present in the prior art, the present invention provides an improved hands free towel carrying system. As such, the general purpose of the present invention, which will be described subsequently in greater detail, is to provide a new and improved hands free towel carrying system and method which has all the advantages of the prior art and none of the disadvantages.

To attain this, the present invention essentially comprises a towel of a generally rectangular configuration. The towel is comprised of an absorbent material of a color of the user's choosing. The towel has a loose end, a parallel coupling end and a pair of side edges therebetween. The side edges are between about 15 percent and 25 percent greater than the length of the loose and coupling ends. The coupling end is formed from the folding over of a top end and coupling the top end to an intermediate portion of the towel through stitching. In this manner a tunnel is formed in the coupling end. The region of the towel forming the tunnel is shirred with inner regions and outer regions adapted to expand and contract to allow enlargement and reduction of the size of the tunnel.

Next provided is a neck loop. The neck loop is of a generally cylindrical configuration and is comprised of an elastomeric material. The neck loop is adapted to be stretched around a user's head without messing up the user's hair and glasses and is adapted to rest around the user's neck. The neck loop forms a base around which the tunnel of the coupling end of the towel can be formed for enlargement and reduction in size. In this manner the towel is retained in a convenient enlarged position during donning by the user and reduced configuration during wearing by the user.

A pocket is next provided. The pocket is positioned on the towel and has a resealable coupling selected from the class of resealable couplings including snaps, buttons, zippers and hook and loop fasteners, preferably a snap. The pocket is adapted to hold loose objects the user desires to keep in safe proximity.

Finally, indicia is positioned on the towel. The indicia is selected from the class of indicia including monograms, advertisement, and sports logos.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hands free towel carrying system which has all of the advantages of the prior art towel of known designs and configurations and none of the disadvantages.

It is another object of the present invention to provide a new and improved hands free towel carrying system which may be easily and efficiently manufactured and marketed.

It is further an object of the present invention to provide a new and improved hands free towel carrying system which is of durable and reliable constructions.

An even further object of the present invention is to provide a new and improved hands free towel carrying system which is susceptible of a low cost of manufacture with regard to both materials and labor, and which accordingly is then susceptible of low prices of sale to the consuming public, thereby making such hands free towel carrying system economically available to the buying public.

Even still another object of the present invention is to provide a hands free towel carrying system for coupling a towel to a user to prevent loss, theft and contamination.

Lastly, it is an object of the present invention to provide a new and improved towel of a generally rectangular configuration comprised of an absorbent material with a loose end, a parallel coupling end, a pair of side edges and a generally cylindrical neck loop comprised of an elastomeric material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
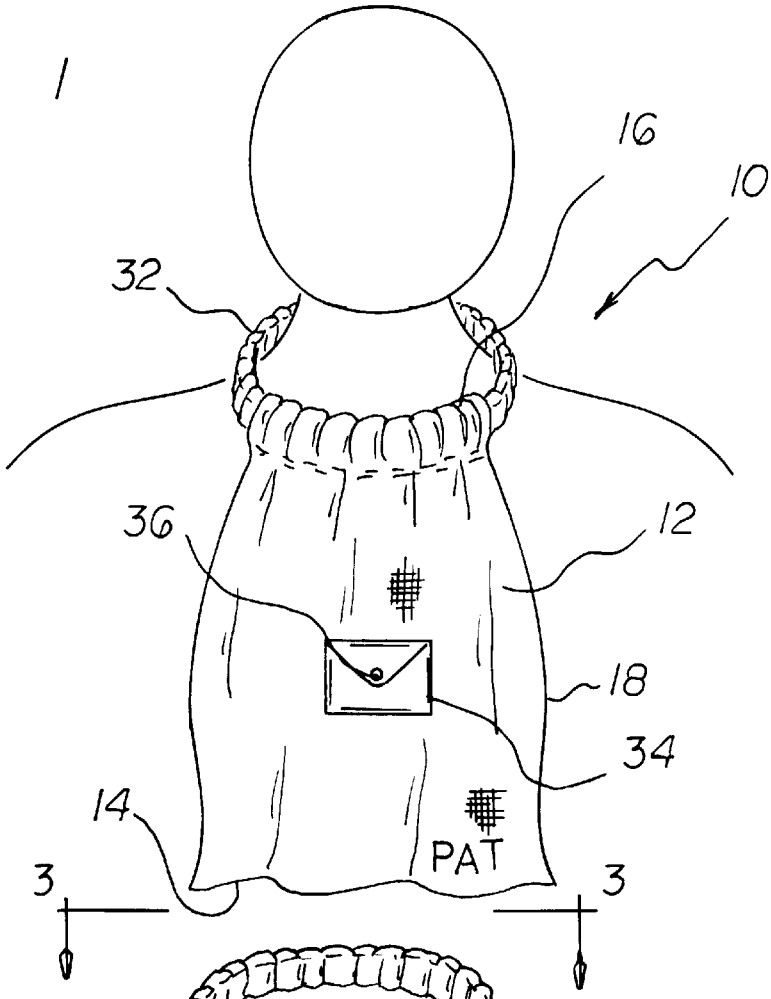
FIG. 1 is a perspective illustration of the primary embodiment of a hands free towel carrying system shown in position on a user.
Figure 2:
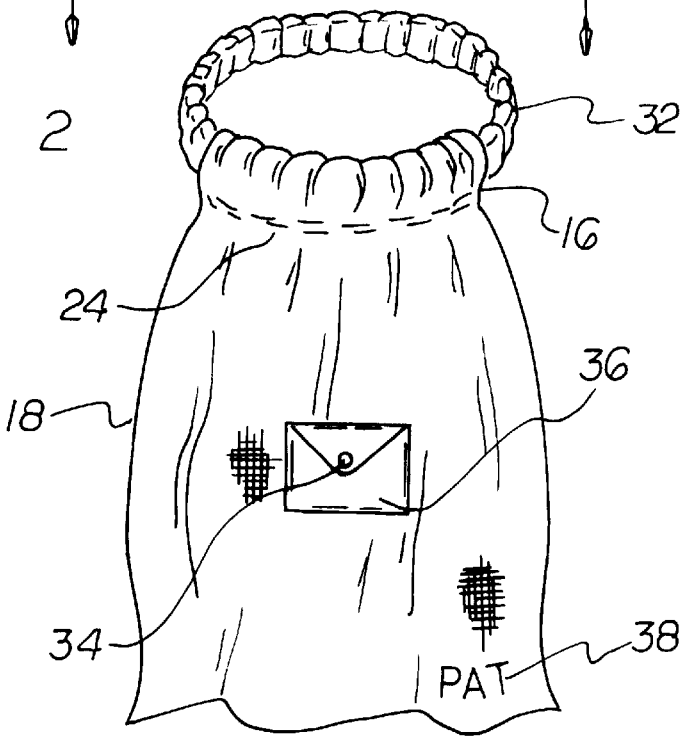
FIG. 2 is an enlarged perspective illustration of the system of FIG. 2 but without the user.
Figure 3:
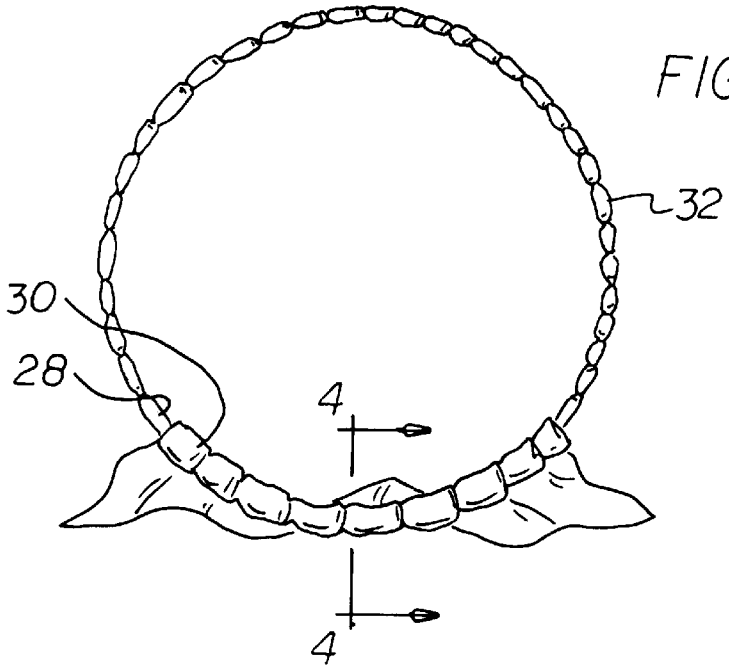
FIG. 3 is a plan view of the system taken along line 3-3 of FIG. 2.
Figure 4:
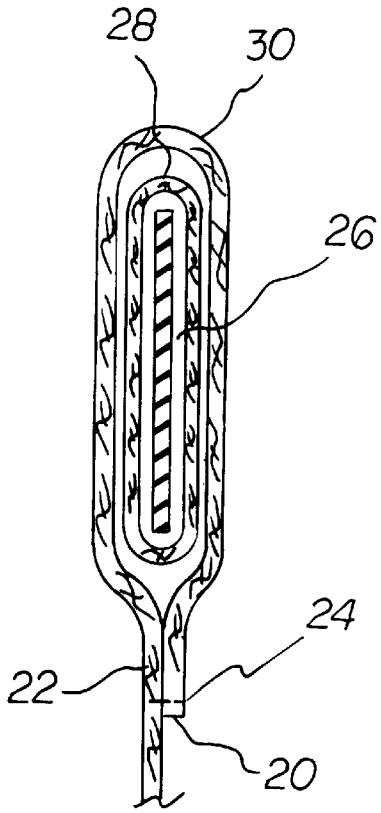
FIG. 4 is a cross sectional view taken along line 4-4 of FIG. 3.

With reference now to the drawings, and in particular to FIG. 1 thereof, the preferred embodiment of the new and improved hands free towel carrying system embodying the principles and concepts of the present invention and generally designated by the reference numeral 10 will be described.

The present invention, the hands free towel carrying system 10 is comprised of a plurality of components. Such components in their broadest context include a towel and a neck loop. Such components are individually configured and correlated with respect to each other so as to attain the desired objective.

First provided is a towel 12 of a generally rectangular configuration. The towel is comprised of an absorbent material of a color of the user's choosing. The towel has a loose end 14, a parallel coupling end 16 and a pair of side edges 18 therebetween. The side edges are between about 15 percent and 25 percent greater than the length of the loose and coupling ends. The coupling end is formed from the folding over of a top end and coupling the top end to an intermediate portion 22 of the towel through stitching 24. In this manner a tunnel 26 is formed in the coupling end. The region of the towel forming the tunnel is shirred with inner regions 28 and outer regions 30 adapted to expand and contract to allow enlargement and reduction of the size of the tunnel.

Next provided is a neck loop 32. The neck loop is of a generally cylindrical configuration and is comprised of an elastomeric material. The neck loop is adapted to be stretched around a user's head without messing up the user's hair and glasses and is adapted to rest around the user's neck. The neck loop forms a base around which the tunnel of the coupling end of the towel can be formed for enlargement and reduction in size. In this manner the towel is retained in a convenient enlarged position during donning by the user and reduced configuration during wearing by the user.

A pocket 34 is next provided. The pocket is positioned on the towel and has a resealable coupling 36 selected from the class of resealable couplings including snaps, buttons, zippers and hook and loop fasteners, preferably a snap. The pocket is adapted to hold loose objects the user desires to keep in safe proximity.

Finally, indicia 38 is positioned on the towel. The indicia is selected from the class of indicia including monograms, advertisement, and sports logos.

Figure 5:
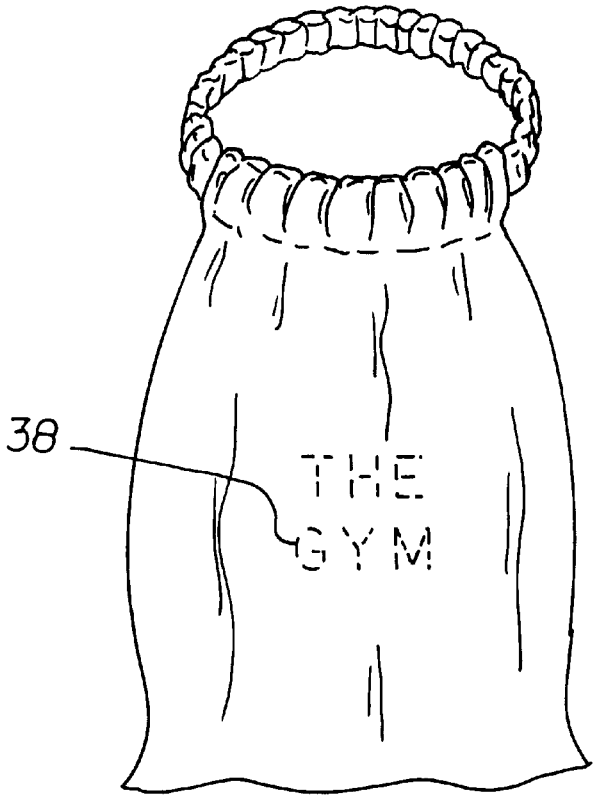
FIG. 5 is an enlarged view similar to FIG. 2 but illustrating an alternate embodiment of the invention.

An alternate embodiment of the invention is shown in FIG. 5. The primary embodiment includes a pocket 34 and a monogram as the indicia. The FIG. 6 embodiment excludes the pocket and adds an advertisement as the indicia 38.

Figure 6:
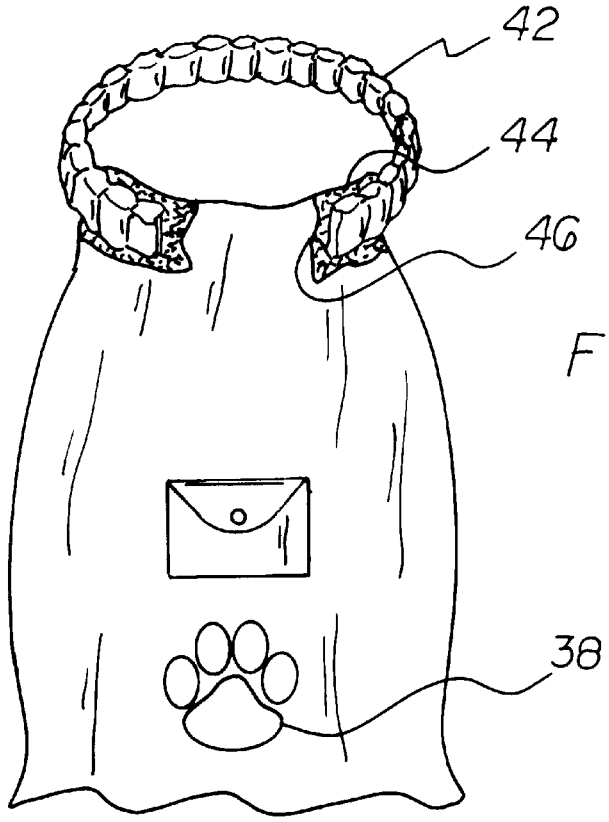
FIG. 6 is an enlarged perspective view similar to FIG. 2 and 5 but illustrating another alternate embodiment of the invention.

Another alternate embodiment of the invention is shown in FIG. 6. In this embodiment, the coupling end includes a neck loop 42 with free ends. A hook and loop fastener 44 is attached to the free ends of the neck loop and a hook and loop fastener 46 is attached to the coupling end of the towel adjacent to the side edges. In this embodiment, the indicia 38 is a sports logo. It should be understood that any combination of pocket and/or indicia could be utilized as desired by a user.

Figure 7:
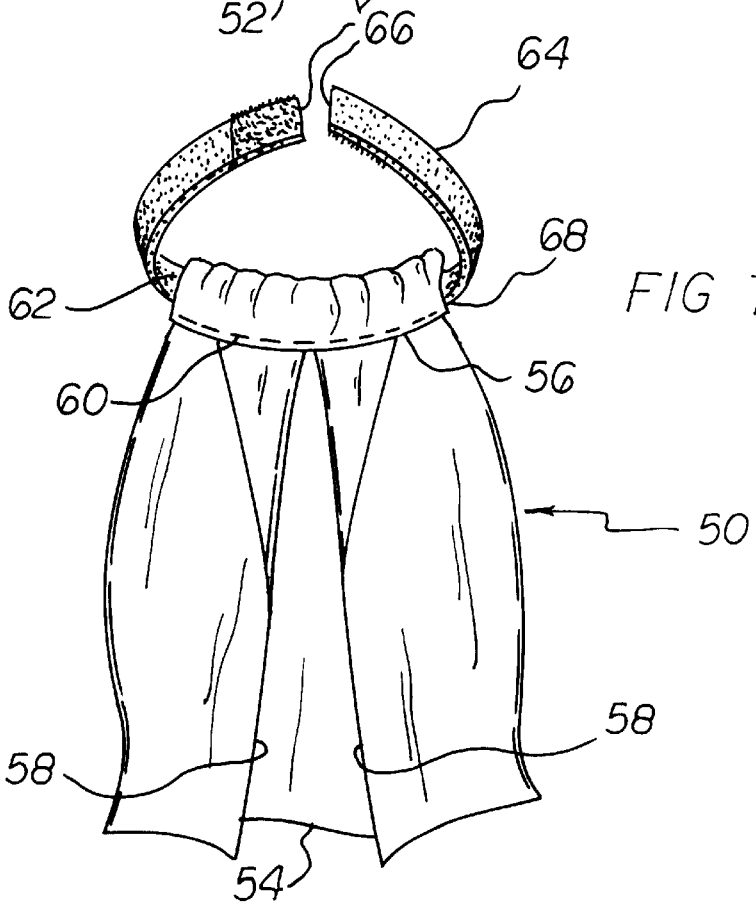
FIG. 7 is an enlarged views similar to FIG. 2 but illustrating yet another alternate embodiment of the invention with a separable loop.

Shown if FIG. 7 is yet another alternate embodiment of the invention. In such embodiment, the hands free towel carrying system 50 is for coupling a towel to a user to prevent loss, theft and contamination. The system comprises a towel 52 of a generally rectangular configuration having a loose bottom end 54 with a parallel coupling top end 56 and a pair of parallel side edges 58 between the bottom and top ends. The towel also has a centerline between and parallel with the side edges. The side edge are folded over whereby the side edges are located adjacent to the centerline unstitched. The top end is folded over and coupled to an intermediate portion of the towel through stitching 60 thereby forming a tunnel 62 adjacent to the top end.

A loop 64, in a generally cylindrical configuration, is comprised of a fabric material with free ends 66 and a central extent 68 there between. Hook and loop fasteners 70 are at the free ends for the coupling and uncoupling of the free ends of the loop. The central extent of the loop is located in the tunnel of the towel. The loop is between about two and three times the length of the tunnel whereby it may extend around the neck of a user.

Figure 8:
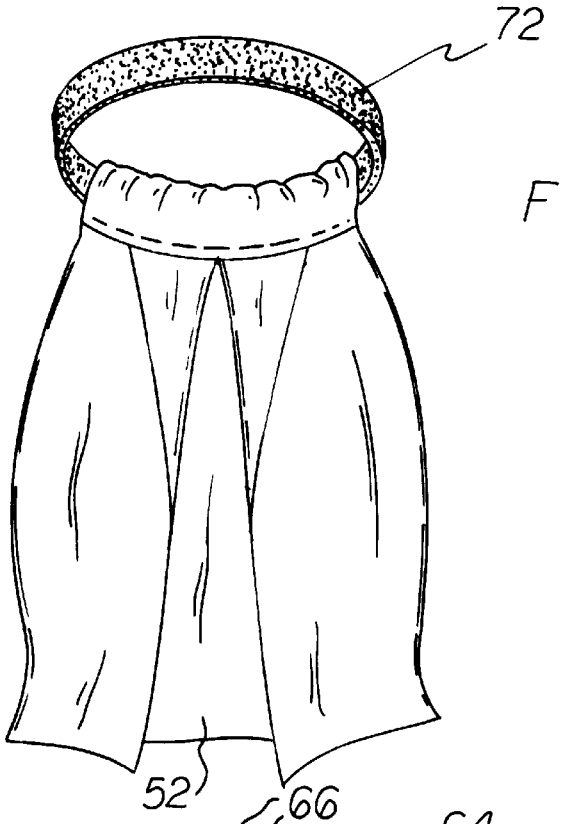
FIG. 8 is an enlarged views similar to FIG. 2 but illustrating yet another alternate embodiment of the invention with an elastic loop.

In the FIG. 8 embodiment, the loop 72 is of an elastic material. The other components of the system are similar to FIG. 7.

Figure 9:
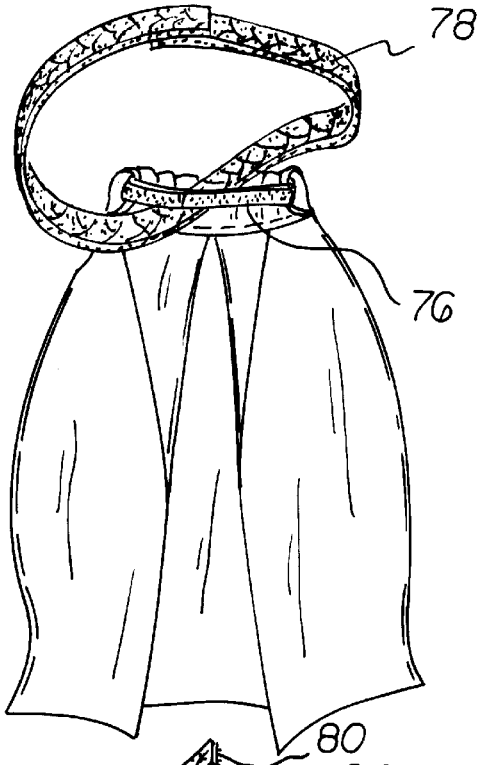
FIGS. 9 and 10 are enlarged views similar to FIG. 2 but illustrating the final alternate embodiment of the invention, FIG. 9 showing the loops coupled for use and FIG. 10 showing the loops uncoupled.
Figure 10:
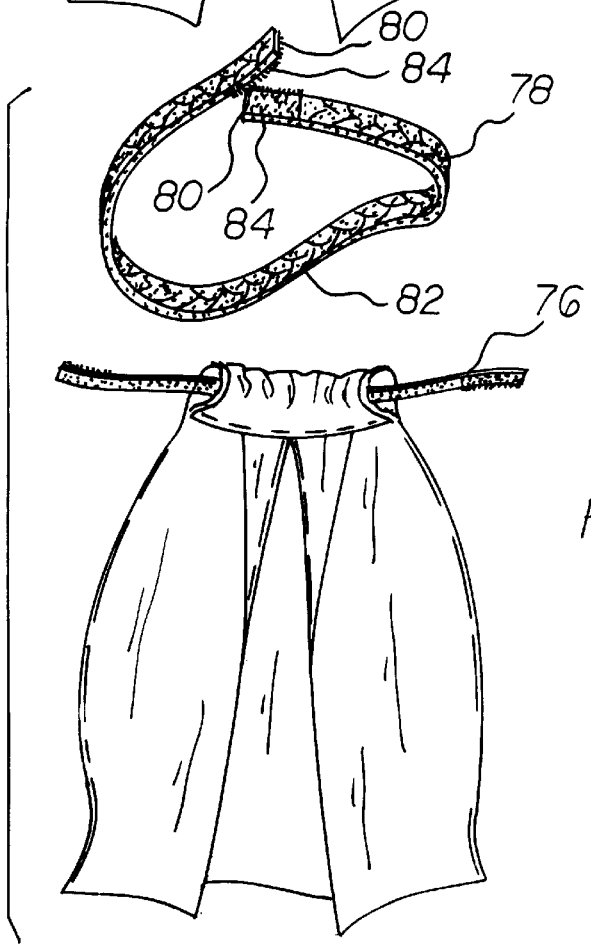

The final embodiment of FIGS. 9 and 10 is similar to that of FIG. 7. In such final embodiment, however, the loop is a short loop 76 about two times the length of the tunnel. Such final embodiment further includes a long loop 78 between about two and three times the length of the tunnel. It is comprised of a fabric material with free ends 80 and a central extent 82 there between. Hook and loop fasteners 84 are at the free ends for the coupling and uncoupling of the free ends of the loop whereby the long loop may extend through the short loop and around the neck of a user.

The present invention is a towel for a user during exercise, work, jogging and any activity where a user would sweat. With the invention, a user's hands are free, but the user could wipe his face or hands, move around and keep his towel with him, not on the ground or floor out of his reach.

The towel is for use around a user's neck on a stretch material which frees the hands. A user does not have to worry about putting down the towel and losing it while doing any activity that requires hands to be free.

This towel can be used when exercising, working in the yard, jogging, working out at a gym—any activity where a user sweats or just wants to or needs to wipe his face or hands and keep his hands free and the towel with him. The towel would be excellent for construction workers, firemen, aerobics instructors, joggers, football players, basketball players, and for concert goers. The towel will not be lost or misplaced. It will always be with the user. A user does not have to worry about another person using his towel as may happen with the use of a regular towel at a gym.

The present invention is an improvement over regular towels in that the user would have to hold a regular towel, try to tie it around his waist, throw it over his shoulder, put it down on a chair, hang or put it on the equipment he is using or some other items while working or doing an activity that needs hands free.

The towel of the present invention never has to be put down, tied around a user's waist, thrown over a shoulder, or put on equipment. It will stay with the user.

The method of construction also shows the improvement. The towel is sewn together with stretchable terry cloth/towel material. The material is made into a circle with a towel looped over the circular part. The circular part stretches so it goes over the head and the towel part can hang down in front or back of the user. This frees up hands. The towel is around the user's neck. The towel can be pulled up to wipe face and hands. When a user let's go, the towel is still with him.

The towel part that hangs down may be used to wipe face, hands, neck, arms, whatever, but the user's hands are free. The towel can be made of different widths, weight and materials. Logos, monograms may be provided on this part. The towel can be of different colors. The towel can be changed if it becomes wet. Indicia may include the American flag, cartoon characters, or any other indicia. A small pocket may be provided on the towel to keep keys and ID. The pocket may have a closure at the top with a snap or other closure used to secure items inside the pocket.

The circular part may attach to the towel part with hook and loop fasteners, hook and eye, metal or plastic loop in any size, snap, button, clamp, sewn on or tied or strapped onto the towel. The loop, circular part can be attached to itself with the items listed and any and all types of binding or attachment material. This allows a user to replace the towel part it if got wet or change towel colors to match outfits. The basic towel circular part would not open and hold only one towel.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A hands free towel carrying system for coupling a towel to a user to prevent loss, theft or contamination comprising, combination:

a towel of a generally rectangular configuration comprised of an absorbent material of a color of the user's choosing, having a loose end, a parallel coupling end and a pair of side edges therebetween, the side edges being between about 15 percent and 25 percent greater than the length of the loose and coupling ends, the coupling end being formed from the folding over of a top end and coupling the top end to an intermediate portion of the towel through stitching thereby forming a tunnel in the coupling end, the region of the towel forming the tunnel being shirred with inner regions and outer regions adapted to expand and contract to allow enlargement and reduction of the size of the tunnel;

a neck loop of a generally cylindrical configuration and being comprised of an elastomeric material, the neck loop being adapted to be stretched around a user's head without messing up the user's hair and glasses and being adapted to rest around the user's neck, the neck loop forming a base around which the tunnel of the coupling end of the towel can be formed for enlargement and reduction in size thereby retaining the towel in a convenient enlarged position during donning by the user and reduced configuration during wearing by the user;

a pocket positioned on the towel and having a resealable coupling selected from the class of resealable couplings including snaps, buttons, zippers and hook and loop fasteners, preferably a snap, with the pocket being adapted to hold loose objects the user desires to keep in safe proximity; and indicia positioned on the towel, the indicia being selected from the class of indicia including monograms, advertisement, and sports logos.

2. A hands free towel carrying system comprising: a towel of a generally rectangular configuration comprised of an absorbent material having a loose end, a parallel coupling end formed from the folding over of a top end and coupling the top end to an intermediate portion of the towel through stitching thereby forming a tunnel in the coupling end, the region of the towel forming the tunnel being shirred with inner regions and outer regions adapted to expand and contract to allow enlargement and reduction of the size of the tunnel, and a pair of side edges there between; and a generally cylindrical neck loop comprised of an elastomeric material.

* * * * *